US006565695B2

(12) United States Patent
Takeuchi et al.

(10) Patent No.: US 6,565,695 B2
(45) Date of Patent: May 20, 2003

(54) TRANSFER SHEET FOR ELECTROPHOTOGRAPHIC PRINTER

(75) Inventors: Tatsuo Takeuchi, Tokyo (JP); Yukio Watanabe, Tokyo (JP); Kenji Nakama, Himeji (JP); Shinichi Morisuna, Kawanishi (JP)

(73) Assignee: Daicel Chemical Industries, Ltd., Osaka (JP)

( * ) Notice: Subject to any disclaimer, the term of this patent is extended or adjusted under 35 U.S.C. 154(b) by 0 days.

(21) Appl. No.: 09/794,103

(22) Filed: Feb. 28, 2001

(65) Prior Publication Data

US 2002/0045031 A1 Apr. 18, 2002

(30) Foreign Application Priority Data

Mar. 1, 2000 (JP) ..... 2000-055302

(51) Int. Cl.[7] ..... B41M 5/00
(52) U.S. Cl. ..... 156/235; 428/195
(58) Field of Search ..... 156/235; 428/195, 428/913, 914

(56) References Cited

FOREIGN PATENT DOCUMENTS

| | | | |
|---|---|---|---|
| EP | 0482923 A1 | | 4/1992 |
| EP | 0711672 A2 | | 5/1996 |
| EP | 0805049 A1 | | 11/1997 |
| JP | A7137427 | | 5/1995 |
| JP | A7137428 | | 5/1995 |
| JP | A825787 | | 1/1996 |
| JP | A1016382 | | 1/1998 |
| JP | 10-207101 | * | 8/1998 |
| JP | 10207101 A | | 8/1998 |

* cited by examiner

*Primary Examiner*—Bruce H. Hess
(74) *Attorney, Agent, or Firm*—Birch, Stewart, Kolasch & Birch, LLP

(57) ABSTRACT

The transfer sheet comprises a support and a transfer layer capable of separating from the support and of fixing a toner image formed by an electrophotographic printer, wherein an average value of a surface roughness of the transfer layer is 0.5 to 3.5 $\mu$m. The transfer layer may comprise a thermoplastic resin and a fine particle. A weight ratio of the thermoplastic resin to the fine particle is about 50/50 to 99/1. The thermoplastic resin may be a thermoplastic polyurethane-series resin, and the fine particle may be a polyethylene fine particle having a mean particle size of about 1 to 100 $\mu$m.

9 Claims, No Drawings

TRANSFER SHEET FOR ELECTROPHOTOGRAPHIC PRINTER

FIELD OF THE INVENTION

The present invention relates to a transfer sheet useful for forming a image on an image-receiving material such as clothes by forming a record image on the transfer sheet with the use of an electrophotographic printer and transferring the record image to the image-receiving material (or member).

BACKGROUND OF THE INVENTION

A variety of printing methods such as a screen printing method typical of them are usually employed in order to print images such as marks, logos and pictures on a surface of clothes such as T-shirts, earthenware, plastic articles or the like. These methods, however, require making an original printing plate, which is expensive. Thus, these methods are not suitable for a small scale of printing from the viewpoint of cost. Further, it is difficult to print rapidly because it takes many hours to make the printing plate.

In order to solve the above problems, there has been recently proposed a process which comprises previously recording an image on a transfer sheet which has a support layer and a transfer layer by means of a ink-jet printer or a color copying machine, and thermal-transferring the record image on the transfer sheet to an image-receiving material such as clothes (e.g., Japanese Patent Application Laid-Open No. 16382/1998(JP-A-10-16382)). In the process for forming a record image on a transfer sheet, a color laser printer, which has been recently popularized rapidly as well as the ink-jet printer can be employed. The color laser printer adopts an electrophotographic system, that is, an image is formed by converting an original image to digital signals, radiating a laser beam to a photosensitive member according to the digital signals and developing with toner. Thus, the color laser printer can provide a high quality image and is suitable for recording an image on a transfer sheet.

Such electrophotographic printers such as the color copying machine and the color laser printer require heating a toner image formed on a transfer layer of a transfer sheet by means of a heat roller to fix the toner image. However, when a temperature of the heat roller is elevated, the transfer sheet adheres to the heat roller to twist around the roller, and the printer often clogs with the sheet.

For solving the problem, there have been proposed, as a transfer sheet for the color copying machine, (i) a sheet comprising three layers of a support layer, a release layer and a thermal adhesive layer, and specifying thickness of the support layer and the thermal adhesive layer (Japanese Patent Application Laid-Open No. 137427/1995(JP-A-7-137427)), (ii) a sheet comprising a transfer layer, a release layer and a support layer, and specifying thickness of the transfer layer and the release layer (Japanese Patent Application Laid-Open No. 25787/1996(JP-A-8-25787)), and (iii) a sheet comprising a support layer and a thermal adhesive layer, and specifying a melting point and a melt index (viscosity) of a polymer constituting the thermal adhesive layer (Japanese Patent Application Laid-Open No. 137428/1995 (JP-A-7-137428)). With respect to these sheets, however, when a temperature of a heat roller is elevated for improving the transferring efficiency in the same case as the electrophotographic printer such as a laser printer, the sheet twists around a heat roller, and the sheet tends to curl. On the other hand, when a heat resistant layer is formed on a surface of a transfer layer, the twist around a heat roller is inhibited, but a thermal transferability is deteriorated.

SUMMARY OF THE INVENTION

Accordingly, it is an object of the present invention to provide a transfer sheet for use in an electrophotographic printer which has the high thermal transferability and can be inhibited to twist or wind around a heat roller.

Another object of the invention is to provide a transfer sheet for an electrophotographic printer which is possible to form a clear or sharp image on an image-receiving material (e.g., clothes) by thermal transferring.

Still further object of the invention is to provide a transfer sheet for an electrophotographic printer, which is possible to form a transfer image having excellent texture or feeling (softness).

Still another object of the invention is to provide a transfer sheet for an electrophotographic printer, which is possible to form a transfer image having excellent water resistance and washing resistance.

As a result of intensive investigations made to solve the above problems, the present inventors found that, by forming a transfer layer having the specific surface roughness on a support, the twist of the transfer sheet for an electrophotographic printer can be inhibited. These findings have now led to completion of the present invention.

Thus, the transfer sheet for an electrophotographic printer of the present invention comprises a support and a transfer layer capable of separating from the support and fixing a toner image. An average value of surface roughness of the transfer layer is 0.5 to 3.5 $\mu$m. The transfer layer may comprise a thermoplastic resin and a fine particle. A weight ratio of the thermoplastic resin to the fine particle may be the thermoplastic resin/the fine particle=about 50/50 to 99/1. The thermoplastic resin may be at least one member selected from the group consisting of thermoplastic polyurethane-series resins, polyamide-series resins, polyester-series resins and polyolefinic resins. The fine particle may be an organic fine particle having a mean particle size of 1 to 100 $\mu$m, and in particular may comprise at least one resin selected from the group consisting of polyolefinic resins, acrylic resins, styrenic resins and silicone-series resins. Moreover, an anchor layer separable from the support may be interposed between the support and the transfer layer.

The present invention also includes a method of forming an image on a image-receiving material, which comprises forming a toner image on the transfer layer of the transfer sheet by an electrophotographic printer, and transferring the image on the image-receiving material.

DETAILED DESCRIPTION OF THE INVENTION

A transfer sheet of the present invention comprises at least a support and a transfer layer capable of separating or peeling from the support and of fixing a toner image formed by an electrophotographic printer. Moreover, an anchor layer separable or peelable from the support may be interposed between the support and the transfer layer.

[Support]

As the support, any of supports such as opaque, semi-transparent and transparent supports may be used as far as the transfer layer and the anchor layer are capable of separating therefrom. Examples of the support usually include a release (releasable) support such as a paper treated for providing releasability, a synthetic paper, a chemical (artificial) fiber paper and a plastic film, which may be treated for providing releasability.

As a paper, there may be mentioned printing papers such as wood free paper, medium quality paper, high-grade groundwood paper, groundwood paper, art paper and coated paper, wrapping papers such as kraft paper and roll paper, thin (tissue) paper such as glassine paper and indian paper, and the like. The paper may be treated or processed. The treatment includes laminating with the use of polypropylene, polystyrene or the like and surface-coating.

As a synthetic paper, there may be mentioned, a variety of synthetic papers made of polypropylene, polystyrene or the like.

As a chemical fiber paper, there may be mentioned, a variety of chemical fiber papers made of chemical fibers such as rayon fiber, acetate fiber, vinylon fiber, nylon fiber, acrylic fiber, vinyl chloride fiber, polyester fiber and polypropylene fiber.

As polymers constituting the plastic film, there may be mentioned polyolefins such as polypropylene; cellulose derivatives such as cellulose acetate; polyesters (e.g., polyalkylene terephthalate such as polyethylene terephthalate and polybutylene terephthalate, polyalkylene naphthalate such as polyethylene naphthalate and polybutylene naphthalate, or copolyesters thereof), polyamides (e.g., polyamide 6, polyamide 6/6), vinyl alcohol-series resins (polyvinyl alcohol, ethylene-vinyl alcohol copolymer), polycarbonates. Among these films, polypropylene, polyester, polyamides or the like is usually employed. In particular, polyesters (especially, polyethylene terephthalate) are preferred from viewpoints of mechanical strength, heat resistance and workability.

The thickness of the support may be selected depending on application fields, and is usually about 10 to 250 $\mu$m, and preferably about 15 to 200 $\mu$m.

The releasability can be provided or imparted by a conventional method, for example, by treating the support with a releasing agent (e.g., a wax, a salt of a higher fatty acid, an ester of a higher fatty acid, an amide of a higher fatty acid, a silicone oil) or by containing the releasing agent in the support. In case of the paper, the releasability can be imparted by coating the paper with a releasing agent (e.g., a silicone) after anchor treatment (e.g., craycoat). If necessary, to the plastic film may be added a conventional additive such as a stabilizer (e.g., an antioxidizing agent, an ultraviolet ray absorber, a heat stabilizer), a lubricant, a nucleation agent, a filler and a pigment.

[Transfer Layer]

An average value of surface roughness of the transfer layer is about 0.5 to 3.5 $\mu$m, preferably about 1 to 3 $\mu$m, and more preferably about 1.5 to 2.5 $\mu$m. The surface roughness is determined according to JIS B0601.

Since the surface of the transfer layer has an uneven structure represented by the above surface roughness, the contact area of the sheet is smaller, and twist around a heat roller can be probably inhibited. Such a transfer layer may be formed by a variety of methods for forming an uneven structure such as a method using a resin composition comprising a thermoplastic resin and a fine particle, as well as a mechanical method such as embossing process.

(Thermoplastic Resins)

The species of the thermoplastic resin is not particularly limited, and resins having a thermal adhesiveness (or hot-melt adhesiveness) are preferred. As such resins, there may be mentioned soft thermoplastic resins such as thermoplastic polyurethane-series resins, polyamide-series resins, polyester-series resins and polyolefin-series resins. These resins may be used singly or in combination.

(1) Thermoplastic Polyurethane-series Resins

Thermoplastic polyurethane-series resin comprises, for example, a urethane-series polymer obtained by reacting a diisocyanate component with a diol component. As the urethane-series polymer, a polyether-type urethane-series resin obtained with the use of a polyether diol as the diol component may be used, but a polyester-type urethane-series resin obtained with the use of at least a polyester diol is preferred. If necessary, a diamine component may be used as a chain-extending agent. The polyurethane-series resin can be formed as a thermoplastic elastomer.

As the diisocyanate component, there may be mentioned aromatic diisocyanates (e.g., phenylene diisocyanate, tolylene diisocyanate, diphenylmethane-4,4'-diisocyanate), an araliphatic diisocyanates (e.g., xylylene diisocyanate), alicyclic diisocyanates (e.g., isophorone diisocyanate), aliphatic diisocyanates (e.g., 1,6-hexamethylene diisocyanate, lysine diisocyanate). Adducts of a diisocyanate compound may be used as the diisocyanate component. If necessary, polyisocyanates such as triphenyl methane triisocyanate may be used in combination. The diisocyanate component may be used singly or in combination of two or more. As the diisocyanate component, isophorone diisocyanate and the like are preferably employed.

As examples of the diol component, there may be mentioned polyester diols, polyether diols (e.g., polyoxytetramethyleneglycol), polycarbonate diols (e.g., a reaction product of a diol with a short-chain dialkyl carbonate), and the others. It is preferred that the diol component contains at least a polyester diol (in particular, an aliphatic polyester diol obtained with use of an aliphatic component as a main reaction component). The diol components may be used singly or in combination of two or more.

The polyester diol may be a diol derived from a lactone, not being limited to diols obtained by reaction of a diol and a dicarboxylic acid or reactive derivatives (e.g., lower alkyl ester, acid anhydride).

As examples of the diol, there may be mentioned aliphatic diols (e.g., $C_{2-10}$alkylene diol such as ethylene glycol, trimethylene glycol, propylene glycol, 1,3-butanediol, 1,4-butanediol, tetramethylene glycol, hexamethylene glycol, neopentyl glycol; polyoxy$C_{2-4}$alkylene glycol such as diethylene glycol, triethylene glycol), alicyclic diols and aromatic diols. The diols may be used singly or in combination of two or more. If necessary, polyols such as trimethylol propane and pentaerythritol may be used in combination with the above diol. The diols is usually an aliphatic diol (e.g., a $C_{2-6}$alkylenediol such as 1,4-butanediol).

As examples of the dicarboxylic acid, there may be mentioned aliphatic dicarboxylic acids (e.g., adipic acid, suberic acid, azelaic acid, sebacic acid, dodecanedicarboxylic acid), alicyclic dicarboxylic acids, aromatic dicarboxylic acids (e.g., phthalic acid, terephthalic acid, isophthalic acid). The dicarboxylic acid may be used singly or in combination of two or more. If necessary, polycarboxylic acid such as trimellitic acid may be used in combination. The dicarboxylic acid is usually a $C_{4-12}$ aliphatic dicarboxylic acid such as adipic acid, isophthalic acid or phthalic acid.

As examples of the lactone, there may be mentioned butyrolactone, valerolactone, caprolactone and laurolactone. The lactone may be used singly or in combination.

These thermoplastic polyurethane-series resin may be used singly or in combination.

(2) Polyamide-series Resins

As examples of polyamide-series resins, there may be mentioned nylon 6, nylon 46, nylon 66, nylon 610, nylon 612, nylon 11, nylon 12, a polyamide resin obtained by reacting of a dimer acid and a diamine, and polyamide-series elastomer (e.g., a polyamide with a polyoxyalkylene diamine as a soft segment). These polyamide-series resin may be used singly or in combination. Among them, the preferred polyamide-series resin includes a nylon containing at least one unit selected from the group consisting of nylon 11 and nylon 12 (e.g., homopolyamides such as nylon 11 and nylon 12, copolyamides such as nylon 6/11, nylon 6/12, nylon 66/12 and a copolymer of a dimer acid, a diamine and a laurolactam or amino undecanoic acid), a polyamide resin obtained by reacting a dimer acid and a diamine.

(3) Polyester-series Resins

As the polyester-series resins, it is preferred from the viewpoint of the thermal adhesiveness that homopolyester resins, copolyester resins, or polyester-series elastomers, which are obtained with using at least an aliphatic diol are employed.

The homopolyester resin includes saturated aliphatic polyester resins obtained by reacting an aliphatic diols (e.g., a $C_{2-10}$alkylene diol such as ethylene glycol, propylene glycol, 1,4-butanediol, 1,6-hexandiol; a polyoxy$C_{2-4}$alkylene glycol such as diethylene glycol) with an aliphatic dicarboxylic acid (e.g., adipic acid, suberic acid, azelaic acid, sebacic acid, dodecanedicarboxylic acid), if necessary, a lactone.

The copolyester resin includes saturated polyester resins which are substituted with another diol (e.g., $C_{2-6}$alkylene glycol such as ethylene glycol, propylene glycol and 1,4-butanediol), another dicarboxylic acid (e.g., the above aliphatic dicarboxylic acid; unsymmetric-type aromatic dicarboxylic acid such as phthalic acid and isophthalic acid) or a lactone (e.g., butyrolactone, valerolactone, caprolactone, laurolactone) for a part of constituting components of a polyethylene terephthalate or polybutylene terephthalate.

The polyester-series elastomer includes elastomers having a $C_{2-4}$alkylene arylate (e.g., ethylene terephthalate, butylene terephthalate) as a hard segment and a (poly) oxyalkylene glycol as a soft segment.

A polyester resin having a urethane bond may be used as the polyester-series resin. As the polyester resin having a urethane bond, a resin of which molecular weight is increased with using the above diisocyanate is preferably used.

These polyester-series resins may be used singly or in combination.

(4) Polyolefinic Resin

The polyolefinic resin includes a homo- or copolymer of an olefin (e.g., α-olefins (in particular, α-$C_{2-10}$olefins) such as ethylene, propylene, 1-butene, 3-methyl-1-pentene, 4-methyl-1-butene, 1-hexene, 1-octene), and an olefinic elastomer. Concretely, as examples of the polyolefinic resin, there may be mentioned polyolefins (e.g., polyethylene such as a low density polyethylene and a linear low density polyethylene, ethylene-propylene copolymer, atactic polypropylene), modified polyolefins [e.g., an ethylene-butene-1 copolymer, an ethylene-(4-methylpentene-1) copolymer, an ethylene-vinyl acetate copolymer, an ethylene-(meth)acrylic acid copolymer or ionomer thereof, ethylene-(meth)acrylate copolymer such as an ethylene-ethyl acrylate copolymer, a propylene-butene-1 copolymer, an ethylene-propylene-butene-1 copolymer, a maleic anhydride-modified or -grafted polypropylene]. Of these, the modified polyolefins are preferred from the viewpoint of thermal adhesiveness. These polyolefinic resins may be used singly or in combination.

Among these thermoplastic resins, from the viewpoint of excellent texture (softness), the thermoplastic polyurethane-series resins are preferred. It is preferred that the softening point of the thermoplastic resin is about 70 to 180° C. (in particular, about 100 to 150° C.).

(Fine Particles)

A fine particle includes an organic fine particle and an inorganic fine particle.

Examples of the inorganic fine particle include, for example, metal powder, white carbon, metal silicate (e.g., calcium silicate, aluminum silicate, magnesium silicate, magnesium aluminosilicate), mineral fine particles (e.g., zeolite, diatomaceous earth, calcined diatomaceous earth, talc, kaolin, sericite, bentonite, smectite, clay), metal carbonate (e.g., magnesium carbonate, heavy calcium carbonate, light calcium carbonate), metal oxide (e.g., alumina, silica, zinc oxide, titanium dioxide), metal hydroxide (e.g., aluminium hydroxide, calcium hydroxide, magnesium hydroxide), metal sulfate (e.g., calcium sulfate, barium sulfate).

The organic fine particle comprises a thermoplastic resin or a thermosetting resin. The thermoplastic resin is particularly not limited as far as an uneven structure can be formed with mixing the above thermoplastic resin, and includes, for example, crosslinked or non-crosslinked organic fine particles of resins such as polyolefinic resins, styrenic resins, acrylic resins, polycarbonate-series resin, polyester-series resins, polyamide-series resins, polyphenylene oxide-series resins and vinyl-series, wax fine particles (e.g., a Fischer-Tropsch wax, an ester wax, a higher fatty acid or a salt thereof, a higher fatty acid ester, a higher fatty acid amide). Among these thermoplastic resins, polyolefinic resins (e.g., crosslinked or non-crosslinked polyethylene, crosslinked or non-crosslinked polypropylene), styrenic resins (e.g., crosslinked or non-crosslinked polystyrene, crosslinked or non-crosslinked polyvinyl toluene, crosslinked or non-crosslinked (styrene-methyl methacrylate copolymer)), acrylic resins (e.g., crosslinked or non-crosslinked polymethyl methacrylate) are preferred. The thermosetting resin is not particularly limited and includes organic fine particles [e.g., a silicone-series resin, an amino resin (e.g., an urea resin, a melamine resin, a benzoguanamine resin), polyurethane-series resin, an epoxy-series resin].

Among the above fine particles, the organic fine particle (especially a particle not being hot-melt adhesive) is preferred in view of the excellent toner fixability and few injuries to an electrophotographic printer. Among the organic fine particles, organic fine particles having high thermal releasability from a heat roller (e.g., at least one resin selected from the group consisting of polyolefinic resins, acrylic resins, styrenic resins and silicone-series resins), in particular, fine particles of the thermoplastic resins (e.g., fine particles of polyolefinic resins such as crosslinked or non-crosslinked polyethylene fine particle) are preferred.

The mean particle size of the fine particle is about 1 to 100 μm, preferably about 3 to 50 μm (for example, about 5 to 50 μm), and more preferably about 10 to 30 μm. The mean particle size of the fine particle is about 0.1 to 4.0 times and preferably about 0.5 to 2.0 times the thickness of the transfer layer.

The weight ratio of the thermoplastic resin to the fine particle is former/latter=about 50/50 to 99/1, preferably about 65/35 to 97/3 and more preferably about 80/20 to 90/10.

(Additives)

If necessary, the transfer layer may be contain a variety of additives (e.g., dye-sticking agents such as a polymeric dye-fixing agent, stabilizers such as antioxidants, ultraviolet ray absorbers and heat stabilizers, antistatic agents, flame retardants, lubricants, antiblocking agents, fillers, colorants, antifoaming agents, coatability improving agents, thickeners, and others).

The coating amount of the transfer layer is about 1 to 100 g/m$^2$, preferably about 10 to 60 g/m$^2$ and more preferably about 10 to 50 g/m$^2$ (e.g., about 20 to 30 gm$^2$). The thickness of the transfer layer is about 5 to 90 $\mu$m, preferably about 10 to 70 $\mu$m, and usually about 5 to 60 $\mu$m (in particular, about 10 to 50 $\mu$m). The thickness of the transfer layer means a minimum thickness of the coating layer formed with the use of a coating agent comprising a fine particle.

Moreover, if necessary, a porous layer, an antiblocking layer, a lubricating layer, an antistatic layer and others may be form on the transfer layer.

[Anchor Layer]

In the transfer sheet of the present invention, an anchor layer may be interposed between the support and the transfer layer. The anchor layer has a role of protecting the transfer layer after transferring its layer to an image-receiving material.

As the anchor layer, a variety of thermoplastic resins and thermosetting resins can be employed as far as the anchor layer is separable from the support and protects the transfer layer, and does not adversely affect the quality of a transfer image. In particular, a polymer having a film-formability (especially a polymer being non-adhesive and having flexibility and suppleness) is employed. Examples of the thermoplastic resins include a variety of resins such as polyamide-series resins, polyester-series resins, styrenic resins, polyolefinic resins, polycarbonate-series resins, polyvinyl acetate-series resins, acrylic resins, vinyl chloride-series resins and thermoplastic urethane-series resins. Examples of the thermosetting resins include alkyd resins, polyurethane-series resins, epoxy-series resins, phenolic resins, melamine-series resins, urea-series resins, and silicone-series resins. Among these resins, since such resins have high wettability toward a support and protect the transfer layer efficiently, alkyd resins and polyester-series resins are preferred. The alkyd resin includes a condensate of a polybasic acid [e. g., an aromatic dicarboxylic acid or an anhydride thereof (e.g., phthalic anhydride, isophthalic acid), polycarboxylic acid or an anhydride thereof (e.g., trimellitic anhydride), an aliphatic dicarboxylic acid or an anhydride thereof (e.g., maleic anhydride, adipic acid, sebacic acid), rosin] with a polyalcohol [e.g., a polyalcohol (e.g., glycerin, pentaerythritol, trimethylol propane), an alkylene glycol (e.g., neopentyl glycol), a poly$C_{2-4}$alkylene glycol (e.g., ethylene glycol, diethylene glycol)], or an alkyd resin modified with vegetable oil.

A coating amount of the anchor layer is about 0.1 to 20 g/m$^2$, preferably about 1 to 10 g/m$^2$ and more preferably about 1 to 7 g/m$^2$. The thickness of the anchor layer is about 0.1 to 10 $\mu$m and preferably about 1 to 5 $\mu$m.

[Production Process]

The transfer sheet of the present invention can be produced by forming the transfer layer on at least one side of the support. The transfer layer can be formed by applying a release surface of the support with a coating agent comprising a thermoplastic resin, a fine particle, if necessary other components.

When an anchor layer is formed, the transfer layer can be formed by applying a release surface of the support with a coating agent for an anchor layer comprising an alkyd resin, a polyester-series resin or others, if necessary drying to form the anchor layer, and then by applying thereon with the coating agent for the transfer layer.

The coating agent can be applied on at least one side of the support by a conventional method such as roller coating, air knife coating, blade coating, rod coating, bar coating, comma coating or graver coating. The coat layer can be formed by drying on a temperature of about 50 to 150° C. (preferably about 80 to 120° C.).

The transfer layer formed by the above method is suitable for forming an image by an electrophotographic printer (with a powdery toner). A record image can be smoothly transferred or conveyed to an image-receiving material by applying an appropriate pressure (e.g., about 5 to 500 g/m$^2$) at an appropriate temperature (e.g., about 140 to 250° C., preferably about 140 to 200° C.) for an appropriate period (e.g., about 5 seconds to 1 minute) with bringing the transfer layer into contact with the image-receiving material, and peeling the transfer layer or the anchor layer from the support. If necessary, the member having the transfer image may be heated for crosslinking.

As the image-receiving material, there may be mentioned two-dimensional or three-dimensional structures made of various materials such as fibers, papers, woods, plastics, ceramics and metals. Cloth (e.g., T-shirts, banners, flags), plastic films or sheets, paper, and others may be usually employed as the image-receiving material.

The transfer sheet for an electrophotographic printer of the present invention does not twist around a heat roller, and thus, achieves high productability, and inhibits curling after printed. Moreover, a clear image can be formed on an image-receiving material (e.g., clothing) by thermal transferring from the transfer sheet of the present invention. The resulting transfer image has excellent texture (softness) and further, has good water resistance and washing resistance.

EXAMPLES

The following examples illustrate the present invention in more detail, but should by no means be construed to limit the scope of the invention. Incidentally, unless otherwise indicated, "part(s)" indicates the proportion by weight. Moreover, the transfer sheets obtained in Examples and Comparative Examples were evaluated for various kind of properties according to the following methods.

Using a laser printer (manufactured by Canon Inc., CP-660), on the transfer sheets obtained in Examples and Comparative Examples were individually printed a determined image with cyane, yellow, magenta and black inks to form the record image.

(Twist Around a Heat Roller)

After feeding the transfer sheet into the printer, twist around a heat roller was visually evaluated according to the following criteria:

A: no twist

B: twist occurred (Sharpness of Image)

After printed, sharpness of image was visually evaluated according to the following criteria:

A: clear or sharp image

B: blurred image

Example 1

A coating agent which contains 90 parts of polyesterurethane (manufactured by Toyobo Co, Ltd., Vylon UR-3200) and 10 parts of polyethylene fine particle (manufactured by Mitsui Kagaku Co, Ltd., Miperon XM-220, a mean particle size of 30 $\mu$m, non-crosslinked fine particle) was prepared. The coating agent was applied on a release paper coated with a silicone in coating amount of 20 to 30 g/m$^2$, and dried to obtain a transfer sheet.

Example 2

A coating agent which contains 90 parts of polyesterurethane (manufactured by Toyobo Co, Ltd., Vylon UR-3200)

and 10 parts of silicone fine particle (manufactured by Shinetsu Kagaku Co, Ltd., KMP598, a mean particle size of 13 μm) was prepared. The coating agent was applied on a release paper coated with a silicone in coating amount of 20 to 30 g/m$^2$, and dried to obtain a transfer sheet.

Example 3

A coating agent which contains 80 parts of polyamide (manufactured by Namariichi Co, Ltd., Fine Resin EM-120) and 20 parts of acrylic fine particle (manufactured by Nippon Shokubai Co, Ltd., Epostar-MA1004, a mean particle size of 4 μm) was prepared. The coating agent was applied on a release paper coated with a silicone in coating amount of 20 to 30 g/m$^2$, and dried to obtain a transfer sheet.

Comparative Example 1

A coating agent which contains 90 parts of polyesterurethane (manufactured by Toyobo Co, Ltd., Vylon UR-3200) and 10 parts of polyamide fine particle (manufactured by Daicel Huels Ltd., Bestamelt 430-Pl, a mean particle size of 1 μm) was prepared. The coating agent was applied on a release paper coated with a silicone in coating amount of 20 to 30 g/m$^2$, and dried to obtain a transfer sheet.

Comparative Example 2

A coating agent which contains 80 parts of polyamide (manufactured by Namariichi Co, Ltd., Fine Resin EM-120) and 20 parts of acrylic fine particle (manufactured by Nippon Shokubai Co, Ltd., Epostar-MA1001, a mean particle size of 1 μm) was prepared. The coating agent was applied on a release paper coated with a silicone in coating amount of 20 to 30 g/m$^2$, and dried to obtain a transfer sheet.

The evaluation results of the transfer sheets obtained in Examples 1 to 3 and Comparative Examples 1 to 2 are shown in Table 1

TABLE 1

| | an average value of surface roughness of the transfer layer (μm) | twist around a heat roller | sharpness of image |
|---|---|---|---|
| Ex. 1 | 2.5 | A | A |
| Ex. 2 | 1.2 | A | A |
| Ex. 3 | 1.0 | A | A |
| Comp. Ex. 1 | 3.6 | A | B |
| Comp. Ex. 2 | 0.4 | B | impossible* |

*a printed image did not be obtained because of twist around a heat roller

As apparent from Table 1, the twist or wind does not occur in the transfer sheets of Examples 1 to 3.

What is claimed is:

1. A transfer sheet which comprises a support and a transfer layer capable of separating from the support and fixing a toner image formed by an electrophotographic printer, wherein said transfer layer comprises thermoplastic resin having hot-melt adhesiveness and organic fine particles, and wherein an average value of surface roughness of the transfer layer is 0.5 to 3.5 μm.

2. A transfer sheet according to claim 1, wherein a weight ratio of the thermoplastic resin to the organic fine particles is 50/50 to 99/1.

3. A transfer sheet according to claim 1, wherein the thermoplastic resin is at least one member selected from the group consisting of thermoplastic polyurethane resins, polyamide resins, polyester resins, and polyolefinic resins, and the organic fine particles have a mean particle size of 1 to 100 μm.

4. A transfer sheet according to claim 3, wherein the organic fine particles comprise at least one resin selected from the group consisting of polyolefinic resins, acrylic resins, styrenic resins, and silicone resins.

5. A transfer sheet according to claim 1, wherein an anchor layer separable from the support is interposed between the support and the transfer layer.

6. A transfer sheet according to claim 1, which comprises a support and a transfer layer capable separating from the support and fixing a toner image formed by an electrophotographic printer, wherein an average value of surface roughness of the transfer layer is 0.5 to 3.5 μm, the transfer layer comprises a thermoplastic polyurethane resin and fine particles of a polyolefinic resin having a mean particle size of 1 to 100 μm, and a weight ratio of the thermoplastic polyurethane resin to the fine particle of the polyolefinic resin is 50/50 to 99/1.

7. A transfer sheet according to claim 1, wherein the mean particle size of the fine particle is 1 to 100 μm, and is 0.1 to 4 times the thickness of the transfer layer.

8. A transfer sheet according to claim 1, wherein the average value of surface roughness of the transfer layer is 1 to 3 μm, the transfer layer comprises a soft thermoplastic resin having a hot-melt adhesiveness and organic fine particle having a mean particle size of 3 to 50 μm, and a weight ratio of the thermoplastic resin to the fine particle is 65/35 to 97/3.

9. A method of forming an image on a image-receiving material, which comprises forming a toner image on the transfer layer of the transfer sheet cited in claim 1 by an electrophotographic printer, and transferring the image on the image-receiving material.

* * * * *